United States Patent [19]

Olmsted et al.

[11] Patent Number: 4,511,872

[45] Date of Patent: Apr. 16, 1985

[54] INDUCTANCE TUNING MEANS AND METHODS OF MANUFACTURE

[75] Inventors: Robert W. Olmsted; Joseph F. Huth, III, both of Butler, Pa.

[73] Assignee: Spang Industries Inc., Butler, Pa.

[21] Appl. No.: 439,372

[22] Filed: Nov. 5, 1982

[51] Int. Cl.[3] ..... H01F 21/06; H01F 41/02

[52] U.S. Cl. ..... 336/83; 29/602 R; 29/608; 264/67; 264/DIG. 58; 336/136; 336/233

[58] Field of Search ..... 29/602 R, 607, 608, 29/606; 264/67, DIG. 58; 336/83, 212, 130, 336/132, 134, 135, 136, 233; 338/87

[56] References Cited

U.S. PATENT DOCUMENTS

| | | | |
|---|---|---|---|
| 2,822,600 | 2/1958 | Scott | 264/67 X |
| 2,905,913 | 9/1959 | Leigh | 336/83 |
| 2,997,584 | 8/1961 | Overfurth | 336/135 |
| 3,092,796 | 6/1963 | Maeda | 336/135 |
| 3,103,642 | 9/1963 | Fuller | 338/87 |
| 3,119,975 | 1/1964 | Arita | 336/136 |
| 3,162,829 | 12/1964 | Wildy et al. | 336/83 |
| 3,267,401 | 8/1966 | Hotine et al. | 336/136 |
| 3,313,017 | 4/1967 | Zingali | 29/606 |
| 3,671,759 | 6/1972 | Dopheide | 336/83 |
| 3,944,958 | 3/1976 | Postma | 336/83 X |
| 4,054,855 | 10/1977 | Schlotterbeck | 336/136 X |
| 4,150,278 | 4/1979 | Resener | 336/83 X |

FOREIGN PATENT DOCUMENTS

| | | | |
|---|---|---|---|
| 754576 | 5/1953 | Fed. Rep. of Germany | 336/136 |
| 1226225 | 10/1966 | Fed. Rep. of Germany | 336/83 |
| 2344372 | 3/1975 | Fed. Rep. of Germany | 336/83 |
| 1400837 | 12/1965 | France | 336/83 |
| 1431710 | 2/1966 | France | 336/83 |
| 815820 | 7/1959 | United Kingdom | 336/136 |

*Primary Examiner*—Thomas J. Kozma
*Attorney, Agent, or Firm*—Raymond N. Baker

[57] ABSTRACT

New ferrite pot core type products and fabrication methods are disclosed for production and assembly of tunable-inductance magnetically-soft ferrite devices. Unitary helical threads formed within the central opening of a ferrite pot core element provide controlled axial movement of a non-threaded male tuning member, carrying a ferrite rod, to adjust the air gap between spaced center posts of an assembled pair of pot core elements. Thread matching and registry requirements are eliminated by such unitary thread means which present either helical path die means, for cutting threads in a cylindrical nonmagnetic portion of a male tuning member or, circumferentially continuous helical threads, which deform nonmagnetic protrusions uniformly distributed about the periphery of a noncircular cross section nonmagnetic portion of a male tuning member during rotation of a male tuning member within a core element central opening.

5 Claims, 10 Drawing Figures

FIG. 1
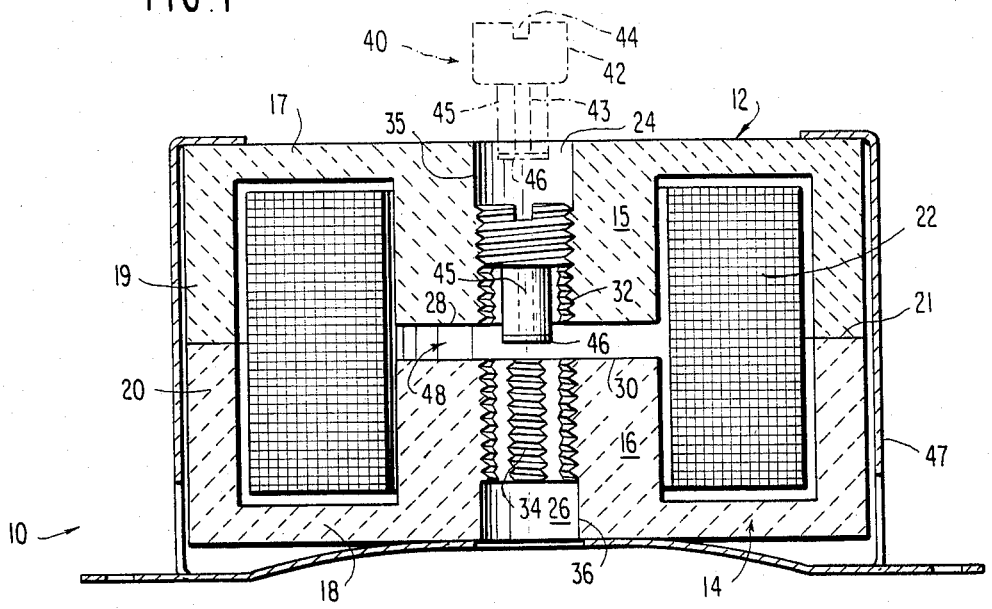
FIG. 2
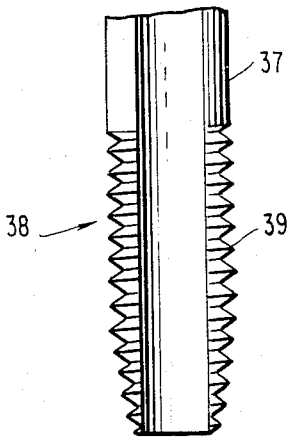
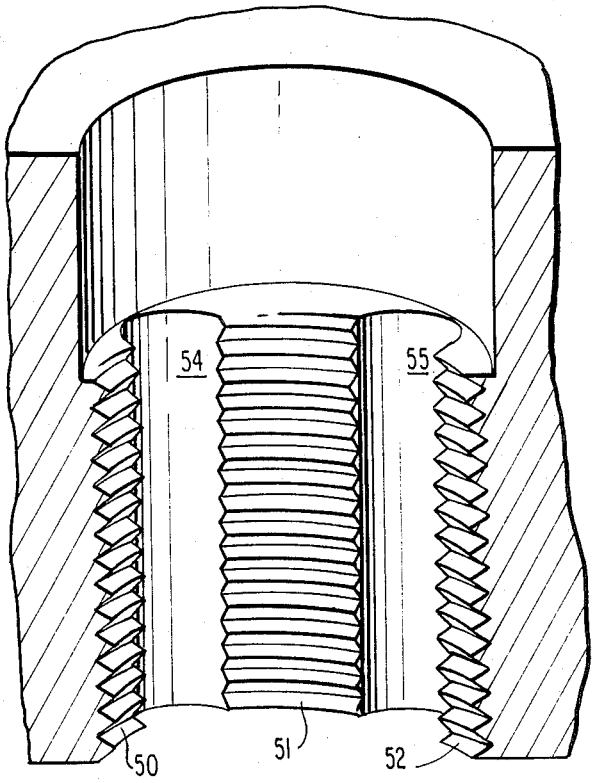
FIG. 3

INDUCTANCE TUNING MEANS AND METHODS OF MANUFACTURE

This invention relates to tunable inductance devices and, more particularly, to new ferrite "pot core" type products and manufacturing methods.

In electrical inductance devices of the type used in many high frequency applications, coil windings are positioned within a ferrite core which is assembled from two core parts having substantially identical magnetic properties. Each core part includes a center post, a radially-extending web at one longitudinal end of the post, and an outer wall skirt portion extending in spaced parallel relation to the center post. The center posts cooperate to provide a central support for a coil bobbin which places the coil windings within the space defined between the central support and the skirt portions of the core elements and distal ends of the skirt portions are provided with mating surfaces in direct engagement to provide a substantially continuous flux path.

In certain applications, especially in telecommunications circuitry, the center posts of two pot core elements have their opposed inner ends in longitudinally spaced relationship to provide an air gap which is used for controlling the inductance of the coil. The present invention contributes products and methods of manufacture which provide for accurate and reliable adjustment of such air gap more economically than was available in the prior art.

Various arrangements have been proposed for tuning an inductor, or the circuit in which the inductor is used. In commercial practice, the center posts include elongated centrally-located cylindrical openings; the central opening of one of the ferrite core elements is provided with internal screw threads by placement of a separately-formed sleeve. A ferrite tuning slug is supported on a male member having external screw threads; the threads on such male tuning member cooperate with the internal threads of the nonmagnetic sleeve in the central opening of one of the core elements to provide for axial movement of the ferrite slug and adjustment of the inductance. With such structures, there is the problem of providing matching configuration threads and, also, providing for registration of the threads of the male and female members.

The present invention contributes a new approach which eliminates such thread matching, tolerance, and registration requirements of the prior practice, thus eliminating related manufacturing and assembly difficulties of the prior practice while providing for accurate and reliable tuning.

Contributions and advantages of the invention are considered more specifically in the description associated with the accompanying drawings, in which:

FIG. 1 is a cross-sectional view of a tunable ferrite core assembly embodying the invention with the male tuning member shown in its position before assembly and after assembly of the core;

FIG. 2 is an elevational view of a tapping element for forming screw threads in accordance with the invention;

FIG. 3 is a perspective view of a portion of one embodiment of a central opening die means of the present invention with a counterbore entrance portion;

Figure 6A:
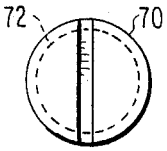
Figure 6B:
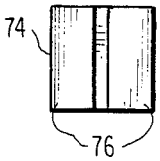
Figure 6C:
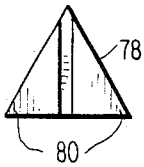
Figure 6D:
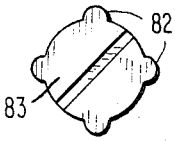
Figure 7:
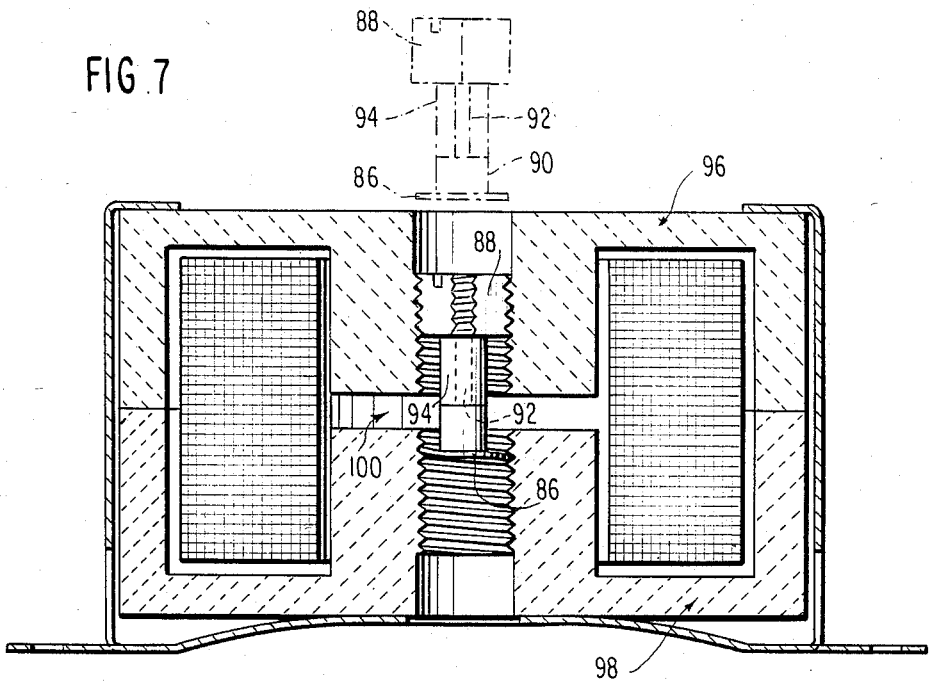

FIGS. 6(*a*) (*b*) (*c*) and (*d*) are end views of nonmagnetic head portions of various male tuning members; and FIG. 7 is a cross-sectional view of a tunable ferrite core assembly with a male tuning member of the type illustrated in FIG. 6(*b*), in positions before and after assembly of the core, and further including distal end stabilizing means for the male tuning member.

The present invention utilizes pot core type elements, in which the center post of each defines a central opening symmetrical about a central longitudinal axis for axial movement of a male tuning member to adjust the air gap between distal ends of the center posts. Requirements for matching the configuration and/or registration of screw threads of male and female members, as required in the prior practice, are eliminated by providing means unitary with the central opening for axial movement of a male tuning member, which is free of the requirement for pre-formed threads, upon rotation of the male member within the central opening.

The pot core elements are molded from particulate ferrimagnetic material at elevated pressure. In one embodiment, the central opening wall surface of a unitary core element is molded with reentrant portions which extend in an axial direction along its length. Prior to sintering of the unitary green compacted part, helically-oriented screw threads are tapped in the wall surface portions of the center opening which are contiguous to the reentrant portions about the inner periphery of the center opening. Such wall surface portions, in which the screw threads are tapped, are closer to the central axis of the core part than the reentrant surface portions. The reentrant portions, being spaced further from the central axis, are open and provide flutes extending axially along the central opening.

High temperature treatment (sintering) of the unitary green compact forms a hardened ceramic in which the helical screw threads tapped in the non-reentrant portions of the center opening wall surface comprise die means for cutting threads in a nonmagnetic portion of a male tuning member. The reentrant portions of the center opening facilitate cutting by receiving cuttings from the nonmagnetic portion of the male tuning member in which screw threads are cut by rotation of the male tuning member in the die means; such rotation providing for controlled axial movement of the male tuning member for adjusting the inductance of the device.

FIG. 1 shows ferrite core elements with the male tuning member in broken lines above the pot core elements in an approach position bor assembly and, also, in solid lines within the center opening after assembly.

Ferrite core 10 includes pot core elements 12 and 14, each including (numbered respectively) a center post 15, 16, web 17, 18, and skirt 19, 20. The skirt portions of the core parts 12 and 14 have mating surfaces and are in direct contact about their peripheries as indicated at 21; coil windings 22 are shown schematically.

In the embodiment of FIG. 1, core parts 12 and 14 are formed with identical wall surfaces for central openings 24, 26 with die means formed in the wall surface of each center opening. Such die means are contiguous to distal ends 28, 30 and comprise portions 32, 34 of the center openings. Counterbore portions 35, 36 are formed at the opposite longitudinal ends of the center openings from the die means positions.

Counterbores 35, 36 provide a centering action for the male tuning member. Such counterbore portions are formed by a longitudinal solid reaming surface such as 37 (FIG. 2) at the supported end of tapping element 38. Tapping thread means 39 are provided at the non-supported end of the tapping element. Tapping threads 39 and counterbore forming surfaces 37 are separated longitudinally by axially extending openings along the exterior surface of tapping element 38 which comprise tapping element flutes.

Male tuning member 40 of FIG. 1 includes a substantially circular cross section head 42 with extension 43 of smaller diameter than head 42. Tool slot 44 is provided in head 42 for applying rotational force. Head portion 42 and extension 43 are formed of nonmagnetic material, preferably a soft plastic. Extension 43 carries ferrite tuning slug 45 which is held on extension 43 by retainer 46. Ferrite tuning slug 45 is formed by pressure composition of ferrimagnetic material followed by sintering to form a ferrite of desired magnetically soft characteristics; such ferrite composition and method of manufacture of such ferrite slugs are well known in the art.

Conventional metal clamp means, as shown schematically at 47, can be utilized for the assembly and for attaching the assembly to a circuit board.

When male tuning member 40 is placed in counterbore 35 and rotated, threads are cut in the substantially cylindrical peripheral surface of the head 42; the axial location of ferrite slug 45 is thereby adjusted in relation to air gap 48 between center post distal ends 28, 30 and the thread matching and registry requirements of the prior commercial practice are eliminated.

An added advantage of the embodiment of FIG. 1 is a reduction in the number of parts which need be kept in inventory as compared to the number of parts required in prior commercial practice. Since the core elements 12 and 14 have substantially identical center opening surfaces, they are interchangeable, and only one type of core element need be inventoried. A further advantage is that the male tuning member can be inserted into the center opening from either axial end of the assembly.

The teachings of the invention provide for various cross-sectional configurations for the center opening of a core element to establish unitary die means. During compaction of the particulate ferrimagnetic material, the center opening is molded to provide reentrant portions extending axially of the interior wall surface. Such axially open reentrant surfaces help define peripherally intermediate wall surface portions of smaller diameter. Helical screw threads are tapped in such smaller diameter portions while the compact is in a green state.

The cutting die means are shown in more detail in FIG. 3 and include helical path threads, such as 50, 51, 52, formed in the smaller diameter wall surfaces with intermediate reentrant portions 54, 55 comprising axially-directed flutes for receiving cuttings from a nonmagnetic portion of the male tuning member during axial positioning and adjustment.

The number of such axially-directed flutes about the inner periphery of the center part can be selected; the flutes are, preferably, symmetrically located for uniform tuning results.

The cross-sectional configuration for the center opening flutes can take the form of curvilinear or linear cross section recesses. The circumferentially discontinuous thread cutting surfaces of the die means preferentially comprise a minor portion of the central opening wall surface.

Figure 4:
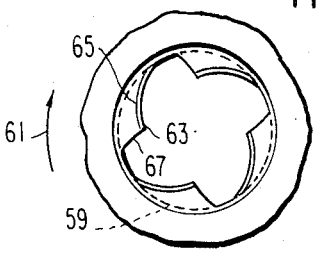
FIGS. 4 and 5 are end views of preferred configurations for thread-cutting central-opening die means in accordance with the present invention.
Figure 5:
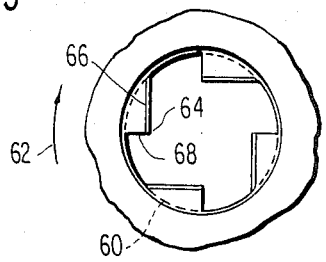

The cross-sectional views of FIGS. 4 and 5 are illustrative of die means configurational teachings which help to maintain the cross-sectional integrity of the central opening during tapping of a green compact. The broken lines 59 and 60 of FIGS. 4 and 5, respectively, represent the root portion of the screw threads tapped in a central opening; arrows 61, 62 represent the direction of rotation of a tapping element in forming screw threads in a green compacted part. Threads are cut in the smaller diameter wall portions, such as 63 of FIG. 4 and 64 of FIG. 5 which provide the crest portions of the threads. Note that, with the types of configuration shown, extended backing support, such as 65 of FIG. 4 and 66 of FIG. 5, is provided to prevent edge chipping of the green compacted material during tapping while, at the same time, edge portions 67 and 68 (FIGS. 4 and 5 respectively) present abrupt edge configurations which facilitate cutting of threads in the nonmagnetic portion of the male tuning member.

FIG. 6*a* shows a circular cross section configuration 70 for the head portion of a male tuning member; threads are cut about the full periphery of such head portion during its rotation by the fluted cross-section central opening die means of, for example, FIGS. 3, 4, or 5; the root portion of cut threads is indicated by broken line 72.

Another important concept of the invention involves a differing approach for eliminating thread matching and registry requirements of the prior commercial practice while enabling accurate tuning of assembled ferrite inductance devices. The invention teaches novel cross-sectional configurations for the peripheral surface of the nonmagnetic head of the male tuning member which involve deformation of nonmagnetic portions of the male tuning member to achieve axial adjustment without requiring formation of die means in the central opening.

Typical cross sectional configurations for the nonmagnetic head portion of the male tuning member are shown in FIG. 6(*b*), 6(*c*) and 6(*d*). In FIG. 6(*b*), a square cross-sectional configuration 74 is provided for the nonmagnetic head portion with corner protrusions such as corners 76. In the FIG. 6(*c*), a triangular cross section 78 for the nonmagnetic head portion is provided with corner protrusions such as 80. In FIG. 6(*d*), protruding lobes such as 82 are provided on nonmagnetic head 83. The protrusions, i.e., corner portions or lobes, are peripherally exterior to the main body of each male member and are spaced peripherally so as not to contact each other when deformed by the crests of the circumferentially continuous unitary threads in the pot core element central openings. Such protrusions as shown in FIGS. 6(*b*), 6(*c*) or 6(*d*) occupy a small portion of the total periphery of the nonmagnetic head surface so as to be readily deformed by rotation of the male member within the unitary threads of a pot core element central opening.

With the embodiments of FIGS. 6(*b*), 6(*c*), and 6(*d*), the central opening of a core element is molded with a cylindrical surface, free of flutes; continuous helical threads are tapped about such central opening wall surface of the green molded part. The cross-sectional dimension at the protrusions of the nonmagnetic head portions is selected to provide axial movement of a male tuning member by deforming, or a combined action of deforming with some cutting of the protrusions; that is the corner portions of the embodiments of FIGS. 6(*b*) and 6(*c*) or the lobe portions of FIG. 6(*d*) are acted on by the continuous helical threads on the central opening wall surface. Use of this concept of the invention with specially shaped nonmagnetic male member and continuous central opening threads is shown in the assembly of FIG. 7.

A variety of nonmagnetic materials can be used with the die means concept since the ceramic ferrites taught will cut threads in both hard and soft plastics as well as certain nonmagnetic metals. However, soft plastics are preferred for both the die means cutting concept and the protrusion deformation concept. Soft plastics exhibit both plastic and elastic characteristics. Engineering plastics of this nature are well known in this art and include, for example, polyesters, polypropylenes and nylons. They exhibit plastic properties which enable them to be cut or deformed but also exhibit elastic properties which provide a tightness of fit which helps to stabilize the male member in a pot core central opening. Hard plastics, such as certain acrylics, e.g. LUCITE, while suitable for cutting with die means would not exhibit the desired plastic characteristic where deformation is involved as taught in relation to FIG. 6(*b*), (*c*) and (*d*).

Provision can also be made for support at both longitudinal ends of a male tuning member. As shown in FIG. 7, a flat resilient washer 86, preferably of soft plastic, with linear sides and corner portions, or protruding lobes, has a cross-sectional dimension corresponding to the maximum cross-sectional dimension of head 88. Washer 86, with retainer 90, is secured to extension 92 holding ferrite sleeve 94 on such extension. Core elements 96 and 98 include continuous-type unitary helical threads as shown. Washer 86 is threaded or pushed through the central opening of core element 96 and into the central opening of core element 98. Washer 86 then supports the remaining end of the male tuning member in core element 98 during and after adjusting of air gap 100 with ferrite sleeve 94.

A typical magnetically-soft ferrite material would have a compositional range of:

about 50 mole % $Fe_2O_3$
about 2–9 mole % FeO
about 31 to 36 mole % MnO, and
about 10 to 15 mole % ZnO.

Also, special purpose additives are typically included in minor percentages which do not significantly alter the basic composition as disclosed in the Goldman et al U.S. Pat. No. 4,097,392. Magnetically-soft ferrites are available commercially from core manufacturers such as Spang Industries, Inc., Butler, Pa. 16001.

In the manufacture of the pot core elements, ferrimagnetic material in particulate form is mixed with a binder such as gum arabic or polyvinyl alcohol for compaction into a green part. Compaction is carried out at pressures generally between about fifteen and thirty tons per square inch. This binder is burned off during heat treatment and sintering is carried out at temperatures generally in the range of about 1200° C. to 1400° C. Such compaction and heat treatment procedures, and suitable materials, are well known in the art.

Unitary threads are tapped within the central opening of the core element while it is in the pressure-compacted green state. A ceramic suitable for cutting threads in, or deforming portions of, the selected nonmagnetic material, is then formed; sintering is carried out to produce a hardness factor in the ceramic in the range of about eighty-five to ninety-five on the Rockwell "C" hardness scale.

In light of the above teachings, other nonmagnetic and ferrite materials than those set forth and other configurations than those specifically shown and described can be resorted to by those skilled in the art while relying on basic concepts of the invention; therefore, in determining the scope of the present invention, reference shall be had to the appended claims.

We claim:

1. Method for manufacturing a magnetically-soft ferrite pot core element to provide unitary means for adjusting the air gap presented by a pair of ferrite pot core elements assembled to form a ferrite pot core in which coil windings are positioned, comprising providing a substantially homogeneous mass of particulate ferrite-forming material which is reactive when treated at elevated temperature to form a magnetically-soft ceramic ferrite, molding such ferrite-forming material at elevated pressure to form a unitary part compacted in a green state for conversion to a ceramic-state ferrite pot core element including an elongated center post symmetrically distributed about a centrally located longitudinal axis, such center post terminating in a distal end surface, lying in a plane which is transverse to the centrally located longitudinal axis, for use in defining an air gap in such assembled electrical inductance device, a web portion extending in transverse relationship to such centrally located axis at the remaining end of such center post longitudinally opposite to such distal end surface, and a skirt portion extending from such web in space relationship from such center post and extending in an axial direction to define a space for positioning coil windings between such center post and such skirt portion, such center post presenting an inner wall surface defining a central opening extending longitudinally with and substantially symmetrically about the centrally located longitudinal axis, such inner wall surface including axially-directed reentrant portions separated by axially-directed non-reentrant portions, establishing unitary die means within such center post central opening for acting on a thread-free nonmagnetic portion of an elongated air gap adjustor member, such die means including helically-oriented screw thread means for providing axial movement of an air gap adjustor member upon rotation within such central opening of a ferrite pot core element, such helically-oriented screw thread means consisting of discontinuous helically-oriented threads established on such axially-directed non-reentrant portions of such center post inner wall surface, such helically-oriented threads being interrupted along such inner wall surface by such axially-directed reentrant portions, such axially-directed reentrant portions defining thread-free longitudinally-open flute means which remain longitudinally open after insertion of such elongated adjustor member into such central opening, such discontinuous helically-oriented screw threads being formed in such non-reentrant portions of the inner wall surface of the central opening of the unitary part compacted from ferrite-forming material while such unitary part is in a green state after pressure compaction, and following forming of such discontinuous screw threads, sintering such core part utilizing an elevated temperature to convert such compacted part from such green state to a ceramic state.

2. A magnetically-soft ferrite pot core element providing unitary means for adjusting the air gap presented by a pair of ferrite pot core elements assembled to form a ferrite pot core in which coil windings are positioned, such pot core element comprising an elongated center post symmetrical about a central longitudinal axis, such center post terminating in a distal end surface, lying in a plane which is transverse to such centrally located axis, for use in defining an air gap in such assembled ferrite pot core, a web extending in a direction transverse to such centrally located axis from the remaining longitudinal end of the center post opposite to such distal end surface, and a skirt portion extending from such web in an axial direction to define a space for positioning coil windings between the exterior surface of such center post and such skirt portion, such center post having an axially-extending inner wall surface defining a central opening for receiving an elongated adjustor member for adjusting the air gap of such assembled ferrite pot core, such central opening wall surface presenting axially-directed reentrant portions separated by axially-directed non-reentrant portions, unitary die means presenting helically-oriented screw threads in the ferrite material of such axially-directed non-reentrant portions for axial-location adjustment of a thread-free elongated adjustor member upon rotation of such member in contact with such die means within such central opening, such helically-oriented thread means being interrupted about periphery of such central opening wall surface by such axially-directed reentrant portions which define flute means, such flute means presenting axially-directed elongated thread-free passage means along such wall surface within such central opening.

3. Adjustable air gap ferrite pot core assembly comprising, in combination, a pair of magnetically-soft ferrite pot core elements, each such core element including an elongated center post symmetrical about a centrally located longitudinal axis, a web extending in transverse relation to such axis contiguous to one longtudinal end of the center post, and a skirt extending from the web generally parallel to and in spaced relation from the center post defining a space for coil windings between the center post and the skirt, each core element skirt terminating in a mating surface for contacting the corresponding mating surface on the remaining core element skirt when in assembled relationship, the center post of each core element terminating in a distal end surface, lying in a plane which is transverse to such centrally located longitudinal axis, with such distal end surfaces being spaced axially from one another when the mating surfaces on the skirts of the pair of core elements are in contacting relationships so as to define an air gap between such distal end surfaces, each core element center post defining a central opening presenting a wall surface which is symmetrically disposed about such centrally located longitudinal axis, such central openings beings in axial alignment when the pair of core elements are assembled for receiving an elongated air gap adjustor member for axially-directed movement within such center openings, such elongated adjustor member presenting a thread-free non-magnetic cylindrical peripheral surface having a predetermined transverse dimension enabling it to be cooperatively received within a central opening of a core element center post, such central opening wall surface of at least one of such pair of core elements presenting axially-directed reentrant portions separated by axially-directed non-reentrant portions, and central opening die means presenting unitary helically-oriented threads located in the ferrite material of such non-reentrant portions of such central opening wall surface of such at least one of such pair of core elements for acting on at least a portion of such thread-free nonmagnetic external peripheral surface of the elongated adjustor member to cause longitudinal movement of such adjustor member along such centrally located axis upon rotation of such adjustor member within such central opening, such helically-oriented threads being interrupted about the periphery of such central opening wall surface by such axially-directed reentrant portions which define thread-free longitudinally-open flute means which remain open after insertion of such elongated adjustor member within such central opening, the nonmagnetic external peripheral surface of such adjustor member engaging and cooperating with such interrupted helically-oriented threads for control of axial positioning of such adjustor member, such adjustor member carrying magnetic material for adjusting the air gap ferrite pot core assembly upon axial movement of such adjustor member within such aligned central openings.

4. The ferrite pot core assembly of claim 3 in which such pair of ferrite pot core elements are substantially identical with die means in respective central opening wall surfaces contiguous to the distal end surfaces of the center post of each core element, and a non-threaded uniform-diameter cylindrical-configuration counterbore portion in each respective central opening wall surface leading to such die means for receiving such adjustor member.

5. Adjustable air gap ferrite pot core assembly comprising, in combination, a pair of magnetically-soft ferrite pot core elements each including a center post symmetrical about a centrally located axis, a web extending from one end of the center post in transverse relation to such axis, and a skirt extending from the web in generally parallel spaced relation from the center post and defining a space for coil windings between the center post and the skirt, each core element skirt terminating in a mating surface for contacting the corresponding mating surface on the other core element skirt in assembled relationship, the center post of each core element terminating in a distal end surface lying in a plane disposed in transverse relationship to such central longitudinal axis with such end surfaces being spaced axially from one another so as to define an air gap therebetween when the mating surfaces on the skirts of the pair of core elements are in contacting relationship, each core element center post defining a central opening presenting a wall surface having axially-directed reentrant portions and axially-directed non-reentrant portions, respective axially-directed reentrant and non-reentrant portions of each core element being in axial alignment when the pair of core elements are assembled for receiving an elongated air gap adjustor member for axially-directed movement within such central openings, central opening die means consisting of unitary helically-oriented threads in the ferrite material of the axially-directed non-reentrant wall surface portions of the central opening of such core elements for providing axial direction movement of an elongated air gap adjustor member upon rotation of such adjustor member in contact with such die means within the central opening of a core element, such helically-oriented threads being interrupted about the periphery of such central opening wall surface by such axially-directed reentrant portions which define flute means, such flute means comprising thread-free longitudinally-open passage means, within such central openings of both core elements, which remain longitudinally open after insertion of such elongated adjustor member, such unitary die means being located along the wall surface of each core element contiguous to the respective distal end surface of each such core element center post, the central opening wall surface of each core element further including a non-threaded uniform-diameter cylindrical-configuration counterbore portion between such die means of each respective core element and its remaining longitudinal end of such central opening which is opposite to its distal end surface, such counterbore portion having a diameter which is no less than the maximum diameter presented by such discontinuous threads and approximates the maximum diameter presented by such non-threaded flute means passages, and an elongated air gap adjustor member adapted to be received within such aligned central openings by insertion along such centrally located axis, through such counterbore portion of one of such pair of core elements selected for insertion of such adjustor member, in a direction toward the die means of such selected core element, such adjustor member including a head portion located at one longitudinal end of such male member, such head portion presenting a thread-free external periphery cylindrical surface of soft plastic non-magnetic material for engaging and cooperating with such die means of such one core element selected for insertion of such adjustor member, magnetic material for adjusting such assembled ferrite pot core air gap upon axial movement of such adjustor member within such aligned central openings, an extension means supporting such magnetic material between such head portion and such remaining longitudinal end of such adjustor member, and a flat resilient washer of soft plastic non-magnetic material secured to such extension means contiguous to such remaining longitudinal end of such adjustor member, such head portion nonmagnetic material having a maximum cross-sectional dimension providing contact about at least a portion of its external periphery with such die means in such core element selected for insertion of such adjustor member so as to cause axial movement of such adjustor member upon rotation of such adjustor member within such central opening, such plastic washer having a cross-sectional dimension corresponding to such maximum cross-sectional dimension of such head portion so as to support such remaining longitudinal end of such adjustor member in the die means of the remaining core element of such pair of ferrite pot core elements.

* * * * *